United States Patent [19]

Sullivan

[11] Patent Number: 4,992,141

[45] Date of Patent: Feb. 12, 1991

[54] THIN, RESIN-SATURABLE AROMATIC POLYAMIDE PAPER AND PROCESS FOR MAKING SAME

[75] Inventor: William J. Sullivan, Richmond, Va.

[73] Assignee: E. I. Du Pont de Nemours and Company, Wilmington, Del.

[21] Appl. No.: 487,467

[22] Filed: Mar. 2, 1990

Related U.S. Application Data

[63] Continuation-in-part of Ser. No. 357,142, May 26, 1989, abandoned.

[51] Int. Cl.[5] ..... D21H 13/26

[52] U.S. Cl. ..... 162/146; 162/157.3; 162/206

[58] Field of Search ..... 162/146, 157.3, 206, 162/138

[56] References Cited

U.S. PATENT DOCUMENTS 4,519,873 5/1985 Amano et al. ..... 162/157.3

*Primary Examiner*—Peter Chin

[57] ABSTRACT

A nonwoven, flexible sheet and process for making same consisting essentially of a comingled mixture of about 55 to about 75% by weight short fibers of poly(-meta-phenylene isophthalamide) and about 25 to about 45% by weight fibrids of poly(meta-phenylene isophthalamide). The sheet has a basis weight of between about 10 and about 25 g/m$^2$ and a thickness of between about 25 and about 45 microns and is impregnatable with resins or silicone oils.

5 Claims, No Drawings

THIN, RESIN-SATURABLE AROMATIC POLYAMIDE PAPER AND PROCESS FOR MAKING SAME

This is continuation-in-part of Ser. No. 357,142, filed May 26, 1989, now abandoned.

BACKGROUND OF THE INVENTION

This invention relates to synthetic, nonwoven sheet structures and more particularly relates to a thin, resin-saturable poly(meta-phenylene isophthalamide) paper and a process for making same.

One type of insulation for the windings of electric motors is a laminated structure of polyester film sandwiched between two layers of resin-impregnated, nonwoven polyester fabric. In some applications, this material cannot withstand the high temperatures experienced in the windings of the motor. Accordingly, for such applications, it is desirable to use a thermally-resistant sheet or laminate with similar electrical insulating properties.

While known poly(meta-phenylene isophthalamide) papers such as those sold under the trademark NOMEX® by E. I. du Pont de Nemours & Company are suitable for many electrical applications, they have only a limited degree of resin-saturability. For some applications, a resin-saturable, thermally-resistant insulating paper is desired, e.g., where a smooth surface is desirable in thermally-resistant insulating papers for electric motors. Also, in copying machines, sheets or papers which can absorb silicone oils are needed for use in cleaner rolls. Furthermore, a thin paper of low basis weight which is also resin-saturable is frequently desired for electric motors and other applications.

SUMMARY OF THE INVENTION

In accordance with the invention, there is provided a nonwoven, flexible sheet structure consisting essentially of a comingled mixture of about 55 to about 75% by weight short fibers of poly (meta-phenylene isophthalamide) and about 25 to about 45% by weight fibrids of poly(meta-phenylene isophthalamide). Sheet structures in accordance with the invention have a basis weight of between about 10 and about 25 g/m$^2$ and a thickness of between about 25 and about 45 microns. In a preferred form of the invention, the sheet structure consists essentially of about 60 to about 70% by weight short fibers of poly(meta-phenylene isophthalamide) and about 30 to about 40% fibrids of poly(meta-phenylene isophthalamide).

In accordance with the process of the invention for making thin, resin-saturable poly(metaphenylene isophthalamide) paper, an aqueous slurry is made comprising solids consisting essentially of about 55 to about 75% by weight short fibers of poly(metaphenylene isophthalamide) and about 25 to about 45% by weight fibrids of poly(metaphenylene isophthalamide) with a solids concentration in the slurry of between about 0.005 and about 0.02% by weight. A wet sheet is formed from the slurry using a paper machine having an inclined wire so that the wet sheet when dried has a basis weight of between about 10 and about 25 g/m$^2$. The wet sheet is dried and is calendered between at least one hard surface roll and at least one resilient, deformable roll to produce a paper having a thickness of between about 25 and about 45 microns. During calendering, the hard surface roll is heated to above about 150° C., preferably between about 150° C. and about 260° C.

In accordance with a preferred form of the process in accordance with the invention, calendering is performed using a hard surface roll having a diameter of between about 25 and about 60 cm and a resilient roll having a diameter of between about 50 and about 90 cm. Nip pressures are between about 160 to 360 kilograms per centimeter.

DETAILED DESCRIPTION

The sheet structure in accordance with the invention can be prepared from short fibers (floc) and fibrids of poly(meta-phenylene isophthalamide) (MPD-I). Suitable floc and fibrids for use in manufacturing papers in accordance with the invention can be prepared in accordance with the procedures set forth in U.S. Pat. No. 3,756,908, which is hereby incorporated by reference. Typically, "high-modulus" floc as described in U.S. Pat. No. 3,756,908 is used. Preferably, the short fibers of the floc have a length less than about 1.3 centimeters (0.5 inch). Typically, for 2 denier MPD-I fibers, an especially useful length is about 0.69 centimeters (0.27 inch).

The floc and fibrids of poly(meta-phenylene isophthalamide) are comingled in the paper with the fibrids serving as a binder. After resin impregnation, the floc in the papers principally provides the strength in the impregnated papers in use and papers in accordance with the invention are made up of about 55 to about 75% floc by weight, preferably about 60 to about 70% by weight. Papers in accordance with the invention are made up of about 25 to about 45% by weight fibrids, preferably about 30 to about 40%.

For the papers to be well-suited to serve as insulation in electric motor windings and other electrical applications and to have good resin-saturability, sheets in accordance with the invention have a basis weight which ranges from between about 10 and about 25 g/m$^2$ and a thickness which ranges from between about 25 and about 45 microns.

The papers of the invention can be produced generally in accordance with the disclosure in U.S. Pat. No. 3,756,908 but, in accordance with the method of the invention, very dilute aqueous floc/fibrid stocks are used to produce wet sheet which, when dried, has a basis weight of between about 10 and about 25 g/m$^2$. A more concentrated slurry of floc and a more concentrated slurry of fibrids can be mixed and further diluted to produce the dilute stocks with solids concentrations in the stocks between about 0.005 and about 0.02% by weight. The dilute stocks are formed into a wet sheet using a paper machine with an inclined wire which can handle the high volumes of dilution water (40–200 gal/-min per inch of width) needed to maintain good fiber dispersion in the very lightweight sheets. A paper machine with an "inclined wire" as used in this application is intended to refer to paper machine with a "flat" wire at an angle of about 10° to horizontal or more or a cylindrical roll former for handling very dilute stocks. Suitable equipment is, for example, an extended wire "ROTOFORMER" disclosed in TAPPI Proceedings for the 1987 Nonwovens Conference (pp. 179–182) and commercially available from the Sandy Hill Corporation of Hudson Falls, N.Y. The wet sheet can be dewatered and dried as disclosed in U.S. Pat. No. 3,756,908.

The as-formed paper is hot calendered to reduce its thickness and to improve its tensile strength. At least one hard surface roll and at least one resilient, deformable roll is used to calender the paper to a thickness of between about 25 and about 45 microns. Commercially-available "fabric calenders" having an unheated somewhat deformable and resilient roll, such as a filled cotton roll, and a heated steel roll are suitable for calendering in accordance with the process of the invention. Calendering in this manner decreases the risk of damage or breaking of the paper during calendering. During calendering, the hard surface (steel) roll is heated to above about 150° C. with a temperature up to the maximum temperature achievable with such commercially-available equipment, e.g., 260° C., being preferred.

In accordance with a preferred process in accordance with the invention, calendering is performed using a hard surface roll having a diameter of between about 25 and about 60 cm and a resilient roll having a diameter of between about 50 and about 90 cm. Nip pressures in the preferred method are between about 160 to 360 kilograms per centimeter.

Papers in accordance with the invention have a combination of properties that makes them particularly useful for electrical insulation such as in motor windings, wire wrap and other electrical insulation applications and in cleaner rolls for copying machines. Papers in accordance With the invention can be used similarly to known materials for such applications as will be apparent to those skilled in the art. The papers are lightweight, thin, and can be readily impregnated with resins or silicone oils. Resin impregnatability of the papers with epoxy resins is superior to that of the lightest weight MPD-I papers available commercially.

EXAMPLES

In the following examples, fibrids and floc ("high-modulus") were prepared as described in U.S. Pat. No. 3,756,908. Ratios and percentages described in the examples are by weight unless otherwise specified. Paper properties are reported after conditioning at about 55% relative humidity and 18° C. for four hours. Paper thickness was determined by measuring using a TMI (Testing Machines Inc., Amityville, Long Island, N.Y.) Series 49-60 Analog Bench Micrometer with a 0.635 cm ($\frac{1}{4}$") diameter foot and an anvil pressure of 1.75 Kg per sq cm (25 psi).

EXAMPLE 1

The handsheet described in Table I was formed in a laboratory handsheet mold and impregnated with epoxy resin using the following procedures.

Slurries of refined fibrids and floc having a length of 0.69 cm (0.27") were prepared at a floc/fibrid ratio of 55/45 to a total solids concentration of about 0.01% by weight and formed into a $8\frac{1}{2}$"×$8\frac{1}{2}$" sheet in the mold. The sheet was drained, removed from the mold, blotted, and dried on a Noble and Wood hot plate (Model F 10).

The as-formed paper was calendered in the nip formed by a heated steel roll (260° C.) with a diameter of 50.8 cm and an unheated filled cotton roll with a diameter of 81.3 cm at a nip pressure of 2000 lb/in (357 Kg/cm). The calender speed was 5 yd/min (4.6 m/min).

For resin impregnation, the calendered paper was cut to $7\frac{1}{2}$"X $7\frac{1}{2}$", weighed, and the thickness was measured. A one-inch wide posterboard tab was stapled to the sample for identification and to facilitate handling of the wet sample. An epoxy resin solution was prepared by mixing:

100 grams of RSM-1212-BH 60 Shell Epoxy resin;
100 grams methyl ethyl ketone; and
0.12 grams 2-methylimidazole catalyst (Eastman Kodak).

The mixed resin solution was poured into a dip pan containing a roller bar. The sample was placed under the roller bar and then pulled around the bar through the resin solution. The impregnated sample was hung vertically for five minutes to allow excess resin to drip off. The sample was then dried for three minutes in a laboratory oven at 149° to 163° C. The edges and posterboard tab were trimmed off. The weight and area of the sample were measured and, from these measurements together with the weight and area of the starting unimpregnated sample, percent resin pick-up was calculated. Results are shown in Table I.

EXAMPLES 2-4

Machine-formed papers described in Table 1 were produced using the following procedures. Resin impregnation was performed by the same procedures as for Example 1 and the results are reported in Table I Floc fibers having a length of 0.27" (0.69 cm) were added to a dilute slurry of refined fibrids to produce three slurries with a total solids concentration of about 0.13%. The weight ratio of floc to fibrids in the slurries was adjusted for the papers indicated in Table I to the respective levels of 70/30, 60/40 and 59/41. The slurries were agitated to keep the floc and fibrids well dispersed.

Each blended floc/fibrid slurry was then diluted with either fresh water or recycled "white water" to a concentration of about 0.01% and pumped to the headbox of a 28 inch extended wire "ROTOFORMER" made by the Sandy Hill Corporation, Hudson Falls, N.Y. The wet lightweight sheet was transferred from the forming wire to a wet press to reduce its water content and then to a series of steam-heated dryer cans heated to a maximum temperature of 166° C. The paper was dried to at least 95% solids and wound into a roll.

The as-formed paper was hot-calendered to reduce its thickness and improve its tensile strength. The machine-formed papers of Examples 2-4 were calendered at the same conditions as the handsheets except that calender speed was 25 yd/min (22.9 m/min) instead of 5 yd/min (4.6 m/min).

COMPARATIVE EXAMPLES 1-2

Commercially-available 1.5-mil (nominal) T-412 and 2.0-mil (nominal) T-410 "NOMEX®" papers (E. I. du Pont de Nemours & Company) were resin impregnated by the same procedures as Example 1 and the results reported in Table I.

TABLE I

| Example No. | Ratio Floc/ Fibrids | Basis Wt. oz/sq yd ($g/m^2$) | Thick. mils (microns) | Density g/cc | Resin Pick-up Wt. % |
|---|---|---|---|---|---|
| Example 1 (Handsheet) | 55/45 | 0.64 (21.9) | 1.7 (43) | 0.50 | 53.9 |
| Example 2 (Machine) | 70/30 | 0.53 (17.9) | 1.3 (33) | 0.54 | 56.4 |
| Example 3 (Machine) | 60/40 | 0.57 (19.2) | 1.6 (40) | 0.48 | 54.1 |
| Example 4 (Machine) | 59/41 | 0.54 (18.2) | 1.3 (33) | 0.55 | 57.7 |
| Comp. Ex. 1 (1.5-mil T-412) | 47/53 | 0.85 (29.0) | 1.7 (43) | 0.67 | 45.6 |
| Comp. Ex. 2 | 47/53 | 1.30 | 2.2 | 0.79 | 38.1 |

TABLE I-continued

| Example No. | Ratio Floc/ Fibrids | Basis Wt. oz/sq yd ($g/m^2$) | Thick. mils (microns) | Density g/cc | Resin Pick-up Wt. % |
|---|---|---|---|---|---|
| (2.0-mil T-410) | | (44.0) | (56) | | |

I claim:

1. A process for making a thin, resin-saturable poly(-metaphenylene isophthalamide) paper comprising:

making an aqueous slurry comprising solids consisting essentially of about 55 to about 75% by weight short fibers of poly(metaphenylene isophthalamide) and about 25 to about 45% by weight fibrids of poly(metaphenylene isophthalamide), said slurry having a solids concentration of between about 0.005 and about 0 02% by weight;

forming a wet sheet from said slurry using a paper machine having an inclined wire, said wet sheet when dried having a basis weight of between about 10 and about 25 $g/m^2$;

drying said wet sheet; and calendering said dried sheet between at least one hard surface roll and at least one resilient, deformable roll to produce a paper having a thickness of between about 25 and about 45 microns, said hard surface roll being heated to above about 150° C.

2. The process claim 1 wherein said calendering is performed with said hard surface roll having a diameter of between about 25 and about 60 cm and with said resilient roll having a diameter or between about 50 and about 90 cm and at a nip pressure of between about 160 to 360 kilograms per centimeter.

3. The process claim 2 wherein said hard surface roll is heated to between about 150° and about 260° C.

4. The process claim 1 wherein said solids in said slurry consist essentially of about 60 to about 70% by weight short fibers of poly(metaphenylene isophthalamide) and about 30 to about 40% fibrids of poly(-metaphenylene isophthalamide).

5. The process claim 1 wherein said short fibers have a length of less than about 2.5 cm.

* * * * *